United States Patent [19]

Lohrberg et al.

[11] 4,370,207

[45] Jan. 25, 1983

[54] PROCESS OF ELECTROLYTICALLY PRODUCING OXYACIDS OF CHLORINE

[75] Inventors: Karl Lohrberg; Rainer Pfohl, both of Heusenstamm; Martin Gritschke, Karben, all of Fed. Rep. of Germany

[73] Assignee: Metallgesellschaft Aktiengesellschaft, Frankfurt am Main, Fed. Rep. of Germany

[21] Appl. No.: 268,421

[22] Filed: May 29, 1981

Related U.S. Application Data

[63] Continuation of Ser. No. 110,155, Jan. 7, 1980.

[30] Foreign Application Priority Data

Jan. 13, 1979 [DE] Fed. Rep. of Germany ..... 2901221

[51] Int. Cl.[3] ..... C25B 1/24

[52] U.S. Cl. ..... 204/95; 204/269

[58] Field of Search ..... 204/95

[56] References Cited

U.S. PATENT DOCUMENTS 3,539,486 11/1970 Fleck ..... 204/95
3,974,051 8/1976 Elliott et al. ..... 204/95
4,046,653 9/1977 De Nora et al. ..... 204/95
4,108,756 8/1978 De Nora et al. ..... 204/95
4,173,525 11/1979 Nakamatsu et al. ..... 204/95

*Primary Examiner*—T. Tung

*Attorney, Agent, or Firm*—Sprung, Horn, Kramer & Woods

[57] ABSTRACT

This invention relates to a process of producing oxyacids of chlorine or salts of such acids by an electrolysis of salt solutions which are contaminated with calcium and/or magnesium or of sea water. In such processes, deposits or crusts are formed on the electrodes in the course of time, particularly in the cells to which the sea water is supplied first. For this reason, the plant must be cleaned from time to time. By means of the invention, a formation of crusts is virtually prevented in that the electrolysis is carried out (a) in an initial phase with an electrolyte flowing at a velocity above 0.7 meter per second and up to 2.0 meters per second and (b) in a succeeding phase with an electrolyte flowing at a velocity of 0.3 meter per second to less than 0.7 meter per second, the velocity of flow being stated for electrolyte which is free from gas.

4 Claims, 1 Drawing Figure

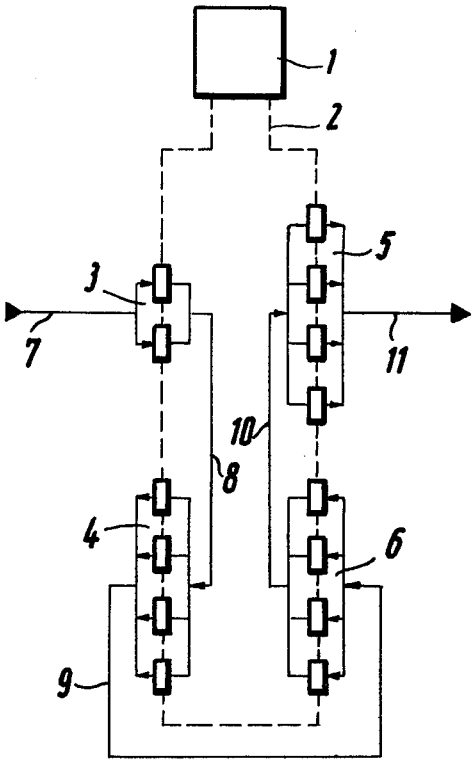
1
2
3
4
5
6
7
8
9
10
11

PROCESS OF ELECTROLYTICALLY PRODUCING OXYACIDS OF CHLORINE

This is a continuation, of application Ser. No. 110,155, filed Jan. 7, 1980.

This invention relates to a process of producing oxyacids of chlorine or salts of such acids by an electrolysis of salt solutions which are contaminated with calcium and/or magnesium or of sea water.

In the electrolysis of sea water and of salt solutions which are contaminated with calcium and/or magnesium, difficulties are still encountered and adversely affect the commercial utilization and economy of the process. Calcium hydroxide or magnesium hydroxide is formed as the calcium or magnesium ions contained in such salt solutions react with the hydroxyl ions produced at the cathode. Magnesium hydroxide tends to adhere to the cathode or to deposit on the walls of the electrolytic cell and thus to obstruct the flow of the electrolyte and to reduce the efficiency. The growing deposits mainly clog the space between the anode and cathode in the electrolytic cell so that the latter cannot be operated continuously for a prolonged time. In an attempt to avoid these difficulties, it has been suggested to use smooth, uninterrupted sheet metal elements as cathodes in the electrolytic production of hypochlorite and to maintain an increased velocity of flow and a predetermined relationship between the velocity of flow and the concentration of the electrolyte (German Offenlegungsschrift No. 26 19 497). In known electrolytic cells for recovering hypochlorite from sea water, structural features have been adopted to cause the electrolyte to flow upwardly at such a velocity that the substances produced at the cathode and anode do not react between the cathode and anode but in a succeeding constricted zone of high turbulence (German Auslegeschrift No. 19 56 156).

In many electrolytic processes, only a short residence time of the electrolyte in the cell is permissible so that a hydraulic series connection is not desirable. On the other hand, the cost of the rectifier required for supplying power to the electrolytic cells requires numerous electrolytic cells to be electrically connected in series. For this reason it is conventional practice in most electrolytic processes, such as the electrolysis of alkali chloride or the electrolytic production of chlorate, to connect the cells electrically in series and to connect them in parallel for the flow of the electrolyte. In plants for the electrolytic production of perchlorate in cells which are electrically connected in series and hydraulically connected in parallel, the electrolyte streams leaving a group of cells connected in parallel have been united and the united stream has been uniformly redistributed to the cells of the next group (Ullmann, vol. 9, IVth edition, page 568; Trans. Electrochem. Soc. 92, 1947, pages 45 to 53).

The previously known processes have not been satisfactory in practice in all cases. In some cases the formation of deposits and crusts in the electrolytic cells occurs in irregular intervals of time and the cells, which may be hydraulically connected in parallel, are affected differently. In other cases it has not been possible to maintain a laminar flow of electrolyte or a flow of electrolyte at a sufficiently high velocity in order to prevent the reaction of chlorine formed at the anode with hydroxyl ions produced at the cathode.

It is an object of the invention to provide a process for the production of oxyacids of chlorine by an electrolysis of salt solutions contaminated with calcium and/or magnesium which avoids the disadvantages of the known processes and can be carried out in a simple manner and which virtually precludes formation of crusts, particularly in the cells to which the sea water is supplied.

SUMMARY OF INVENTION

This invention contemplates an improvement in a process of producing oxyacids of chlorine or salts of such acids by an electrolysis of salt solutions contaminated with calcium and/or magnesium or of sea water, the improvement residing in that the electrolysis is carried out in an initial phase with an electrolyte flowing at a velocity above 0.7 meter per second and up to 2.0 meters per second and in a succeeding phase with an electrolyte flowing at a velocity of 0.3 meter per second to less than 0.7 meter per second, the velocity of flow being stated for an electrolyte which is free from gas.

The process according to the invention can be carried out in an arrangement in which a group of cells which are hydraulically connected in parallel are preceded by individual cells. The ratio of the number of preceding cells to the number of cells of the succeeding group is up to 1:1. When there is more than one preceding cell, these proceding cells may be hydraulically connected in series or in parallel. All cells of the plant are electrically connected in series. The sea water is supplied first to the preceding cell or cells. The velocity of the electrolyte in the preceding cells is much higher than in the parallel cells of the succeeding group. A greatly increased velocity of flow during the first phase of the electrolytic process will reliably prevent a formation of crusts by salts which cause hardness. The velocity of flow should preferably lie in the range from above 0.7 meter per second up to 1.4 meters per second. The electrolyte which has flown at a higher velocity during its treatment in the first phase then enters the second phase of the treatment at a lower velocity of flow, which is preferably from 0.5 meter per second to less than 0.7 meter per second. In some cases, e.g., when the gas content of the electrolyte varies greatly, local conditions existing in the electrolytic cell owing to its structure may cause the actual velocity of flow of the electrolyte in the succeeding phase to rise to 0.7 meter per second or even to 0.9 meter per second. Such temporary changes are compensated by the regulation of the velocity of flow. The velocity of flow of an electrolyte which is free from gas is preferably adjusted to lie in the range from 0.5 to less than 0.7 meter per second. At a velocity of flow within said range, deposits in the succeeding groups of cells which are hydraulically connected in parallel are avoided. It is believed that this is due to the presence of an adequate quantity of hypochlorite ions, which can obviously prevent a formation of deposits of calcium hydroxide or magnesium hydroxide or calcium carbonate or can dissolve previously formed deposits.

In carrying out the process according to the invention the electrolytic plant is suitably arranged so that all individual elements or electrolytic cells are electrically connected in series but can be hydraulically connected in parallel or in series in different numerical relations in dependence on the properties of the raw material, such as the content of salts causing hardness in sea water, brackish water, or salt solutions.

In a special embodiment of the process according to the invention, an initial phase of the electrolysis is carried out in an electrolytic cell which precedes a group of four electrolytic cells which are hydraulically connected in parallel and serve for the succeeding phase.

The anodes used in carrying out the process according to the invention in conventional electrolytic cells may consist of graphite. Particularly preferred electrodes consist of titanium, niobium or tantalum and are coated with noble metal or noble metal oxide or so-called dimensionally stable anode whose electrocatalytic activity is due to the presence of mixed oxides of noble metals and film-forming metals, particularly titanium.

Particularly suitable cathode materials consist of wear-resistant metallic materials, preferably steel, titanium and nickel and alloys of nickel or of iron.

In a preferred embodiment of the process, in which the velocity of flow is high in the initial phase and much lower in the succeeding phase, a group of cells are operated which are hydraulically connected in parallel, the electrolyte streams leaving said cells are united and the united stream is subsequently distributed to electrolytic cells which are hydraulically in parallel. In this embodiment, the electrolyte can be controlled in a simple and advantageous manner to flow at different velocities in several phases in adaption to the different properties of the raw material regarding the tendency to form deposits.

BRIEF DESCRIPTION OF DRAWING

The invention will be explained more fully with reference to the accompanying drawing which is a flow scheme and the example below.

The drawing shows a rectifier 1, which is electrically connected to electrolytic cells and groups of cells 3, 4, 5, 6 by lead 2. Electrolyte consisting, e.g., of sea water enters from the supply conduit 7 the preceding cells 3 for the initial phase. The electrolyte leaving the preceding cell or cells is supplied in conduit 8 to a group of cells 4, which are hydraulically connected in parallel, and is electrolyzed there in a succeeding phase at a lower velocity of flow. The electrolyte streams leaving the several cells of said group are re-united and the united stream is supplied via conduits 9 and 10 to hydraulically series-connected additional groups of cells which in each group are connected in parallel. The flow of electrolyte is distributed to said cells. Sodium hypochlorite solution is finally discharged at 11.

EXAMPLE

The cooling water used in a nuclear power plant is chlorinated. The sodium hypochlorite required for this purpose is supplied by an electrolysis plant, which has a capacity of 10.5 metric tons of chlorine (active chlorine of the sodium hypochlorite) per day. 72 individual elements are required for a production at that rate and are divided into three electrolyte circuits of 24 elements each. The 24 elements of each electrolyte circuit are hydraulically connected in series in sets of six elements each and four of said sets are hydraulically connected in parallel. All elements are electrically connected in series. The elements have vertical anodes and cathodes. The anodes consist of expanded titanium metal covered with mixed oxides consisting of titanium dioxide and ruthenium dioxide. The cathodes consist of Hastelloy C, a highly alloyed nickel-base alloy. Each element has a width of 230 mm and a depth of 68 mm and contains 9 cathodes and 8 anodes, each of which has a thickness of 1.5 mm. Each of the four rows of elements which are hydraulically connected in parallel is supplied with 20 $m^3$ sea water per hour. The sea water contains about 30 l g NaCl per liter and about 100 ppm calcium and magnesium. The supply of water at that rate results in a velocity of 0.57 meter per second if the hydrogen which is evolved is not taken into account. The first cell of each of the four rows of six elements each are provided with anodes and cathodes having a thickness of 2.5 mm. The electrodes of the remaining cells have a thickness of 1.5 mm. Owing to that measure there is a smaller cross-sectional area for the flow of the sea water and the velocity in the first cells, i.e., of the cells to which the water is supplied first, increases to 0.9 meter per second. Owing to this arrangement there is virtually no formation of crusts in the first cells and the period for which the plant can be operated between two cleaning operations which may be required is doubled.

What is claimed is:

1. A process for producing an oxyacid of chlorine or a salt of such acid by an electrolysis of a salt solution which is contaminated with calcium and/or magnesium or of sea water, which comprises:

(a) passing said salt solution through a first electrolytic cell comprising at least one cathode and at least one anode disposed apart from one another, such that the effective velocity of the salt solution through said cell is above 0.9 meter per second and up to 2.0 meters per second; and (b) thereafter passing the salt solution from step (a) through at least one succeeding electrolytic cell comprising at least one cathode and anode disposed at a distance apart from one another further than said cathode and anode of said first electrolytic cell are disposed from one another and establishing in said succeeding electrolytic cell a velocity for the salt solution of 0.3 meter per second to less than 0.7 meter per second, the velocity stated being for salt solution free from gas.

2. A process according to claim 1 wherein the electrolysis is carried out in the first cell at a velocity of flow above 0.9 and up to 1.4 meters per second and in the succeeding cell at a velocity of flow of 0.5 to less than 0.7 meter per second.

3. A process according to claim 1 wherein the electrolyte streams leaving a plurality of first electrolytic cells which are hydraulically connected in parallel and electrically connected in series are united and the united stream is then redistributed to succeeding electrolytic cells which are hydraulically connected in parallel.

4. A process according to claim 1 wherein the velocity of said electrolyte in said first cell is 0.9 meters per second and the velocity in said succeeding cell is 0.57 meters per second.

* * * * *